US006171158B1

(12) United States Patent
Henmi et al.

(10) Patent No.: US 6,171,158 B1
(45) **Date of Patent: *Jan. 9, 2001**

(54) COOLING SYSTEM FOR SMALL WATERCRAFT

(75) Inventors: Yasuhiko Henmi; Yoshihiro Gohara, both of Shizuoka (JP)

(73) Assignee: Yamaha Hatsudoki Kabushiki Kaisha (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/949,459

(22) Filed: Oct. 14, 1997

(30) Foreign Application Priority Data

Oct. 14, 1996 (JP) ..... 8-270655

(51) Int. Cl.[7] ..... B63H 11/00
(52) U.S. Cl. ..... 440/38; 440/88
(58) Field of Search ..... 440/88, 89, 38; 114/270

(56) References Cited

U.S. PATENT DOCUMENTS 3,233,573 2/1966 Hamilton .
4,423,696 1/1984 Aker .
4,437,841 3/1984 Stallman .
4,699,597 10/1987 Oja .
4,787,328 11/1988 Inoue .
5,366,397 11/1994 Suganuma et al. .
5,472,359 12/1995 Allbright, Jr. et al. .
5,752,863 * 5/1998 Baker et al. ..... 440/88
5,766,046 * 6/1998 Ogino ..... 440/88
5,788,547 * 8/1998 Ozawa et al. ..... 440/88

FOREIGN PATENT DOCUMENTS 664183 6/1963 (CA) .

* cited by examiner

*Primary Examiner*—Stephen Avila
(74) *Attorney, Agent, or Firm*—Knobbe, Martens, Olson & Bear, LLP

(57) ABSTRACT

A water inlet tap for an engine cooling system is provided on a jet propulsion unit of a small watercraft. The inlet tap includes a filter element arranged at the inlet of the tap so as to lie generally flush with in inner surface of the jet propulsion unit. In this position, the principal flow of water through the jet propulsion unit tends to sweep away debris at the inlet of the tap in order inhibit fouling of the filter. The filter, as well as the tap itself, are removably attached to one side of the jet propulsion unit for easy servicing.

36 Claims, 4 Drawing Sheets

COOLING SYSTEM FOR SMALL WATERCRAFT

BACKGROUND OF THE INVENTION

1. Field of the Invention

The present invention relates in general to a small watercraft, and in particular to a cooling system for a small watercraft.

2. Description of Related Art

Personal watercrafts have become popular in recent years. Jet propulsion units usually power such watercrafts and offer a number of advantages over propeller driven systems. One such advantage is the ability to run in very shallow water. The jet propulsion units can also supply pressurized cooling water to an open-loop cooling system for the engine and the associated exhaust system.

For this purpose, watercraft today commonly include a delivery conduit which extends between the jet propulsion unit and a water jacket of the engine. The delivery conduit is connected to a water influent port which normally communicates with the pressure chamber of the propulsion device. Pressurized water within the chamber flows into the influent port and into the delivery conduit. The cooling water thence flows through the engine and exhaust system water jackets, and is discharged overboard, usually through a telltale port and/or the exhaust system.

Although the jet propulsion unit provides an adequate source of pressurized water, such water is not always free from foreign debris. Frequently foreign objects and particles may be drawn into the jet propulsion unit, especially when the jet propulsion unit operates in shallow water. Such foreign and small articles and objects often include such matter as weeds, small pebbles and stones, small pieces of driftwood and like debris. If the jet propulsion unit draws in such articles and the articles become entrained in the water flow through the jet propulsion unit, the foreign articles often enter the delivery conduit and clog, either partially or entirely, the water flow through the cooling system. As a result, an adequate supply of cooling water may not be delivered to the engine and the associated components, such as for example, the exhaust system. Overheating of the engine and exhaust system thus can result. Operating the engine and exhaust system at elevated temperatures can of course significantly reduce the performance of the engine, and under some conditions can possibly damage the engine.

Some personal watercraft have employed a filter within the delivery conduit to remove foreign material. The foreign material which enters and is present in the delivery conduit upstream of the filter, however, can still clog the delivery conduit as well as the filter itself. Such an in-line filter therefore requires routine maintenance and periodic replacement, which adds to the expense and effort associated with running the watercraft. In addition, the inclusion of an in-line water filter and the associated filter housing and fittings, increases the cost of the watercraft.

SUMMARY OF THE INVENTION

A need therefore exists for a simply structured filtering arrangement which removes small articles and debris from the water flow entering the delivery line of an engine cooling system, without normally requiring periodic cleaning and replacement.

An aspect of the present invention involves a small watercraft comprising an internal combustion engine that drives a jet propulsion unit. The jet propulsion unit includes a discharge nozzle and an impeller. The impeller acts upon water within the jet propulsion unit and forces the water through the discharge nozzle. The discharge nozzle, as well as an effluent port which is formed through a housing of the jet propulsion unit, are both located downstream of the impeller. A cooling system for the engine includes a water inlet tap connected to said effluent port. The inlet tap includes a filter positioned within the effluent port and is substantially coextensive therewith. The filter includes a plurality of openings.

Another aspect of the present invention involves a jet propulsion unit comprising an impeller, a discharge nozzle, and a pump chamber. The pump chamber is positioned between the impeller and the discharge nozzle. The jet propulsion unit further comprises a water effluent port that communicates with the pump chamber and a filter that is removably installed within the effluent port. The filter is arranged to lie generally flush with an inner surface of the pump chamber. As a result, any debris, which the filter separates from the water flow through the filter, will be swept off the filter by the water flow across the filter and discharged through the discharge nozzle.

Further aspects, features, and advantages of the present invention will become apparent from the detailed description of the preferred embodiment which follows.

BRIEF DESCRIPTION OF THE DRAWINGS

The above-mentioned and other features of the invention will now be described with reference to the drawings of a preferred embodiment of the present watercraft. The illustrated embodiment is intended to illustrate, but not to limit the invention. The drawings contain the following figures.

DETAILED DESCRIPTION OF A PREFERRED EMBODIMENT OF THE INVENTION

The present cooling system has particular utility for use with personal watercraft, and thus, the following describes the cooling system in the context of a personal watercraft. This environment of use, however, is merely exemplary. The present cooling system can be readily adapted by those skilled in the art for use with other types of watercraft as well, such as, for example, but without limitation, small jet boats and the like.

Figure 1:
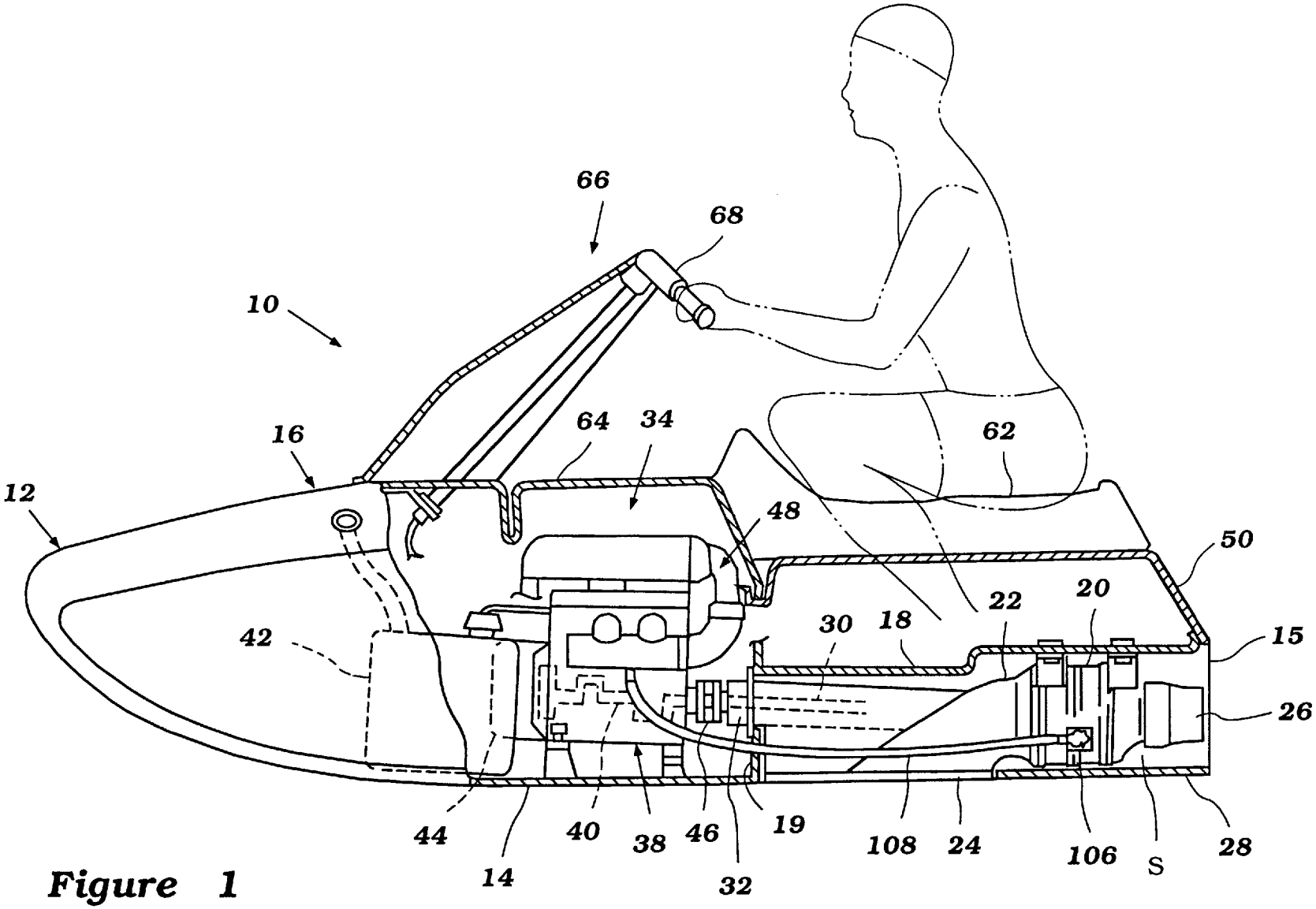
FIG. 1 is a side elevational view of the small watercraft configured in accordance with preferred embodiment of the present invention, with a portion broken away and shown in section in order to depict several of the internal components of the watercraft.
Figure 2:
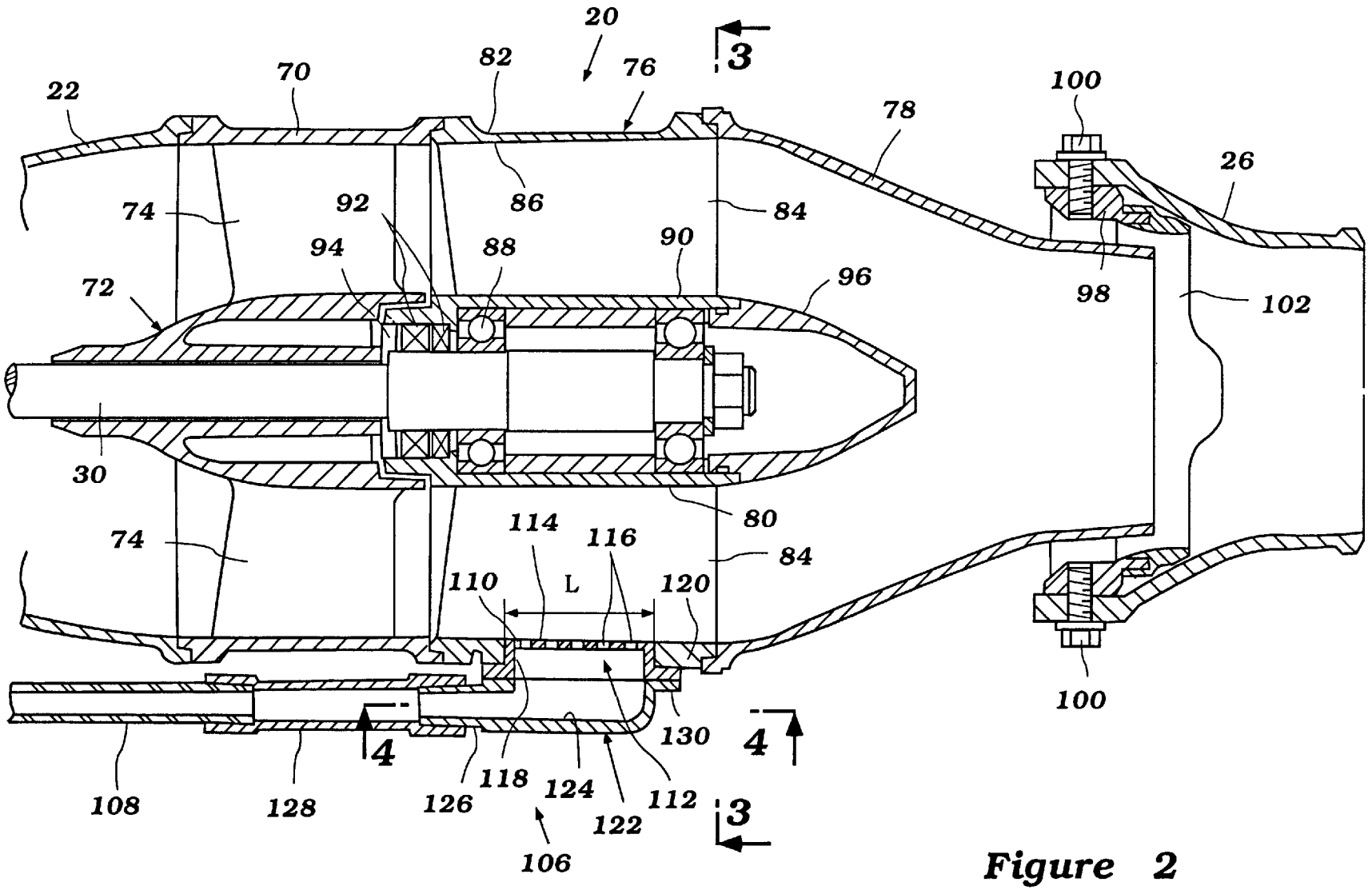
FIG. 2 is a partial cross-sectional view of a jet propulsion unit of the watercraft of FIG. 1 and illustrates a water inlet tap of a cooling system for the watercraft's engine.

With initial reference to FIGS. 1 and 2, the watercraft 10 includes a hull 12 that is formed by a lower hull section 14 and an upper deck section 16. The hull sections 14, 16 are formed of a suitable material such as, for example, a molded fiberglass reinforced resin, and can be made by any of a wide variety of methods. For instance, the deck 16 and hull 14 can each be formed using a sheet molding compound (SMC), i.e., a mixed mass of reinforced fiber and thermosetting resin, that is processed in a pressurized, closed mold. The molding process desirably is temperature controlled such that the mold is heated and cooled during the molding process. For this purpose, male and female portions of the mold can include fluid jackets through which steam and cooling water can be run to heat and cool the mold during the manufacturing process.

The lower hull section 14 and the upper deck section 16 are fixed to each other around their peripheral edges in any suitable manner. For instance, the peripheral flanges of the upper deck 16 and the lower hull 14 can be bonded together.

The lower hull 14 is designed such that the watercraft 10 planes or rides on a minimum surface area of the aft end of the lower hull 14 in order to optimize the speed and handling of the watercraft 10 when up on plane. For this purpose, in the illustrated embodiment, the lower hull section 14 generally has a V-shaped bottom wall configuration formed by a pair of inclined section that extend outwardly from the keel line to outer chines at a dead rise angle. The inclined sections extend longitudinally from the bow toward the transom 15 of the lower hull 14 and extend outwardly to side walls of the lower hull 14. The side walls are generally flat and straight near the stem of the lower hull 14 and smoothly blend towards the longitudinal center of the watercraft 10 at the bow. The lines of intersection between end inclined section of the bottom wall and the corresponding side wall form the outer chines of the lower hull section 14. Of course, the present cooling system can be used with hulls have other configurations.

Toward the transom 15 of the watercraft, the incline sections of the lower hull extend outwardly from a recessed channel or tunnel 18 that extends upward toward the upper deck portion 16. The tunnel 18 has a generally parallelepiped shape and opens through the rear of the transom 15 of the watercraft 10, as understood from FIG. 1. The tunnel terminates at its front end in a front wall. In the illustrated embodiment, the front wall forms part of a bulkhead 19 within the hull 12.

In the illustrated embodiment, a jet pump unit 20 propels the watercraft 10. The jet pump unit 20 is mounted within the tunnel 18 formed on the underside of the lower hull section 14 by a plurality of bolt. An intake duct 22 of the jet pump unit 20 defines an inlet opening 24 on the bottom side of the lower hull section 14. The jet pump unit 20 will be described in greater detail below.

A steering nozzle 26 is supported at the downstream end of the jet pump unit 20 by a pair of vertically extending pivot pins. In an exemplary embodiment, the steering nozzle 26 has an integral lever on one side.

A ride plate 28 covers a portion of the tunnel 18 behind the inlet opening 24 to form a pump chamber S within the tunnel 18. In this manner, the lower opening of the tunnel 18 is closed to provide in part a planing surface for the watercraft 10.

An impeller shaft 30 extends forward of the jet pump unit 20 through a cylindrical casing that is integrally formed with the intake duct 22. The impeller shaft 30 extends through the bulkhead 19 and is desirably supported thereon by a rubber bearing/seal assembly 32. The assembly 32 includes grease-back seals to inhibit water from the intake duct from entering the hull 12.

The lower hull portion 14 principally defines an engine compartment 34 forward of the bulkhead 19. Except for some conventional air ducts, the engine compartment 34 is normally substantially sealed so as to enclose an engine 38 and the fuel system of the watercraft 10 from the body of water in which the watercraft is operated.

An internal combustion engine 38 of the watercraft drives the impeller shaft 30 to power the jet pump unit 20. The engine 38 is positioned within the engine compartment 34 and is mounted centrally within the hull 12. Vibration-absorbing engine mounts secure the engine 38 to the bottom wall of the lower hull portion 14 in a known manner.

In the illustrated embodiment, the engine 38 includes two in-line cylinders and operates on a four-stroke principle. The engine 38 is positioned such that the row of cylinders lies parallel to a longitudinal axis of the watercraft 10, running from bow to stern. This engine type, however, is merely exemplary. Those skilled in the art will readily appreciate that the present hull can be used with any of a variety of engine types having other number of cylinders, having other cylinder arrangements and operating on other combustion principles (e.g., two-stroke crankcase compression principle).

A cylinder block and a cylinder head assembly desirably form the cylinders of the engine. A piston reciprocates within each cylinder of the engine 38 and together the pistons drive a crankshaft 40, in a known manner. The crankshaft 40 desirably is journalled with a crankcase, which in the illustrated embodiment is formed between a crankcase member and a lower end of the cylinder block. A connecting rod links the corresponding piston to the crankshaft 40. The corresponding cylinder bore, piston and cylinder head of each cylinder forms a variable-volume chamber, which at a minimum volume defines a combustion chamber.

The cylinder block and cylinder head also include a plurality of water jackets that extend through the engine block and cylinder head. Together these water jackets form a portion of an open-loop water cooling system for the engine 38.

Each combustion chamber communicates with a charge former of an induction system. The induction system receives air through a throttle device and fuel from a fuel tank 42, which is positioned within the hull 12, and produces the fuel charge which is delivered to the cylinders in a known manner. In the illustrated embodiment, the engine also includes an lubricant injection system. The injection system injects lubricant (e.g., oil) from a lubricant tank 44 into the induction system in order to deliver the lubricant to the engine together with the fuel charge.

In the illustrated embodiment, the crankshaft 40 directly drives the impeller shaft 30; however, the engine can include a drive mechanism that interconnects the crankshaft to an output shaft of the engine. Such a drive mechanism in some applications can reduce the rotational speed (i.e., step down the speed) of the output shaft relative to the crankshaft 40.

As seen in FIG. 1, a coupling 46 in the illustrated embodiment interconnects the engine crankshaft shaft 40 to the impeller shaft 30. The coupling desirably is positioned between the support bearing 32 on the bulkhead and the aft end of the engine 38.

An exhaust system 48 of the engine 38 is provided to discharge exhaust byproducts from the engine 38 to the atmosphere and/or to the body of water in which the watercraft 10 is operated. The exhaust system includes an exhaust manifold that is affixed to the side of the cylinder block and which receives exhaust gases from the variable-volume chambers through exhaust ports in a well-known manner. The exhaust manifold includes a water jacket that communicates with one or more water jackets of the engine cylinder block.

An exhaust pipe extends from the manifold to a water trap device (not shown). The exhaust pipe can include one or more expansion chambers along its length and desirably house a catalytic treatment system. A cooling jacket also desirably extends along at least a portion of the exhaust pipe's length (e.g., about the catalytic treatment system) and, in the illustrated embodiment, receives cooling water from a delivery line (not shown) that extends between the cylinder head water jacket and the exhaust pipe water jacket. The exhaust pipe water jacket communicates with the exhaust pipe at a point downstream of the catalytic treatment system in order to introduce at least a portion of the cooling water into the exhaust stream for silencing purposes. A downstream exhaust pipe (not shown) is connected to the water trap and extends over the tunnel 18 to a discharge end, which opens either into the tunnel or through the transom of the watercraft hull.

As understood from FIG. 1, the upper deck 16 and the lower hull portion 14 together define a pair of raised gunnels positioned on opposite sides of the aft end of the upper deck assembly 16. The raised gunnels define a pair of foot areas and aft deck that extend generally longitudinally and parallel to the sides of the watercraft 10. In this position, the operator and any passengers sitting on the watercraft 10 can place their feet in the foot areas with the raised gunnels shielding the feet and lower legs of the riders. A non-slip (e.g., rubber) mat desirably covers the foot areas and deck to provide increased grip and traction for the operator and the passengers.

Toward the aft end of the watercraft, a seat pedestal 50 rises above the foot areas. The pedestal 50 supports a seat cushion 62 to form a seat assembly. In the illustrated embodiment, the seat assembly has a longitudinally extending straddle-type shape which may be straddled by an operator and by at least one or two passengers. For this purpose, the raised pedestal 50 has an elongated shape and extends longitudinally along the center of the watercraft 10. The seat cushion 52 can be removably attached to the pedestal 50 by a quick-release latching assembly, as known in the art. An access opening (not shown) can be formed, at least in part, beneath the seat cushion 60 to provide access into the engine compartment 34. A separate removable cover 64, which forms a portion of the upper deck 16 forward of the seat 62, can also be used to cover the access opening, as illustrated in FIG. 1.

A control mast 66 is positioned just forward of the seat 62. The control mast 66 includes a steering column that supports a steering operator 68. In the illustrated embodiment, the steering operator is a handlebar assembly; however, other steering operators, such as, for example, a steering wheel or a control stick (i.e., joystick), also can be used. The steering column operates a steering actuator. A lever projects from a lower end of the steering column. An end of a steering cable, such as a bowden-wire actuator, is attached to the lever such that rotational movement of the steering column actuates the steering cable in a conventional manner. The bowden-wire actuator in turn moves the steering nozzle 26 to effect directional changes of the watercraft 10. In the illustrated embodiment, the bowden-wire cable is attached to the lever on the side of the steering nozzle 26; however, it is understood that other types of actuators also can be use to actuate the steering nozzle 26.

FIG. 2 illustrates a cross-sectional view of the jet propulsion unit 20 from an upper side. The inlet duct 22 leads to an impeller housing 70 in which an impeller 72 of the jet pump 20 operates. In the illustrated embodiment, the impeller includes a plurality of blades 74; however, the impeller can be configured in accordance with any of a wide variety of impeller design which will be well known to those skilled in the art. An impeller duct assembly 76, which acts as a pressurization chamber, delivers the water flow from the impeller housing 26 to a discharge nozzle 78.

The impeller duct assembly 76 includes a stationary central hub 80 and a concentrically positioned housing 82. A plurality of stationary straightening vanes 84 are arranged within the housing 82 so as to lie downstream of the impeller 72. Each straightening vane 84 extends generally parallel of a rotational axis of the impeller shaft 30 and spans the distance between the central hub 82 and an inner cylindrical wall 86 of the housing 82.

Each vane 84 includes a pitched leading edge which desirably matches the swirl of the water stream imparted by the impeller 72. The vane 84 thence straightens to extend generally parallel to the rotational axis of the impeller shaft 30. Each vane 84 also extends outward in generally a radial direction. The vanes 84 are equally spaced about circumference of the hub 80 and the inner surface 86 of the housing 82.

The central hub 80 houses a bearing assembly that supports and journals the aft end of the impeller shaft 30. The bearing assembly includes front and rear bearing 88, 90 arranged at opposite ends of the central hub 80. A pair of seals 92, which are held in place by a retaining washer 94, close a front end of the central hub 82. A cap 96 closes the aft end of the central hub 80.

In the illustrated embodiment, a gimbal ring 98 supports the steering nozzle 26 on the discharge nozzle 78. The gimbal ring 98 permits pivoting of the steering nozzle 26 both about a vertical axis for steering movement and about a horizontal axis for trim position adjustment. A plurality of bolts 100 attach the steering nozzle 26 to the gimbal ring 98 in a manner that permits rotation of the steering nozzle 26 about a vertical axis that extends through both bolts 100. A rubber seal 102 is placed between the discharge end of the discharge nozzle 76 and the steering nozzle 26 in order to inhibit a back flow of water between these two components.

The cooling system receives a portion of the pressurized water from the jet propulsion unit 20 in order to supply water to the water jackets of the engine 38 (in the engine block and/or about the exhaust system). For this purpose, as seen in FIG. 1, the cooling system includes an inlet water tap 106 and a delivery line 108 that connects to a water jacket on the exhaust manifold. The tap i106 s attached to the side of the jet pump unit 20 at a point downstream of the impeller.

Figure 3:
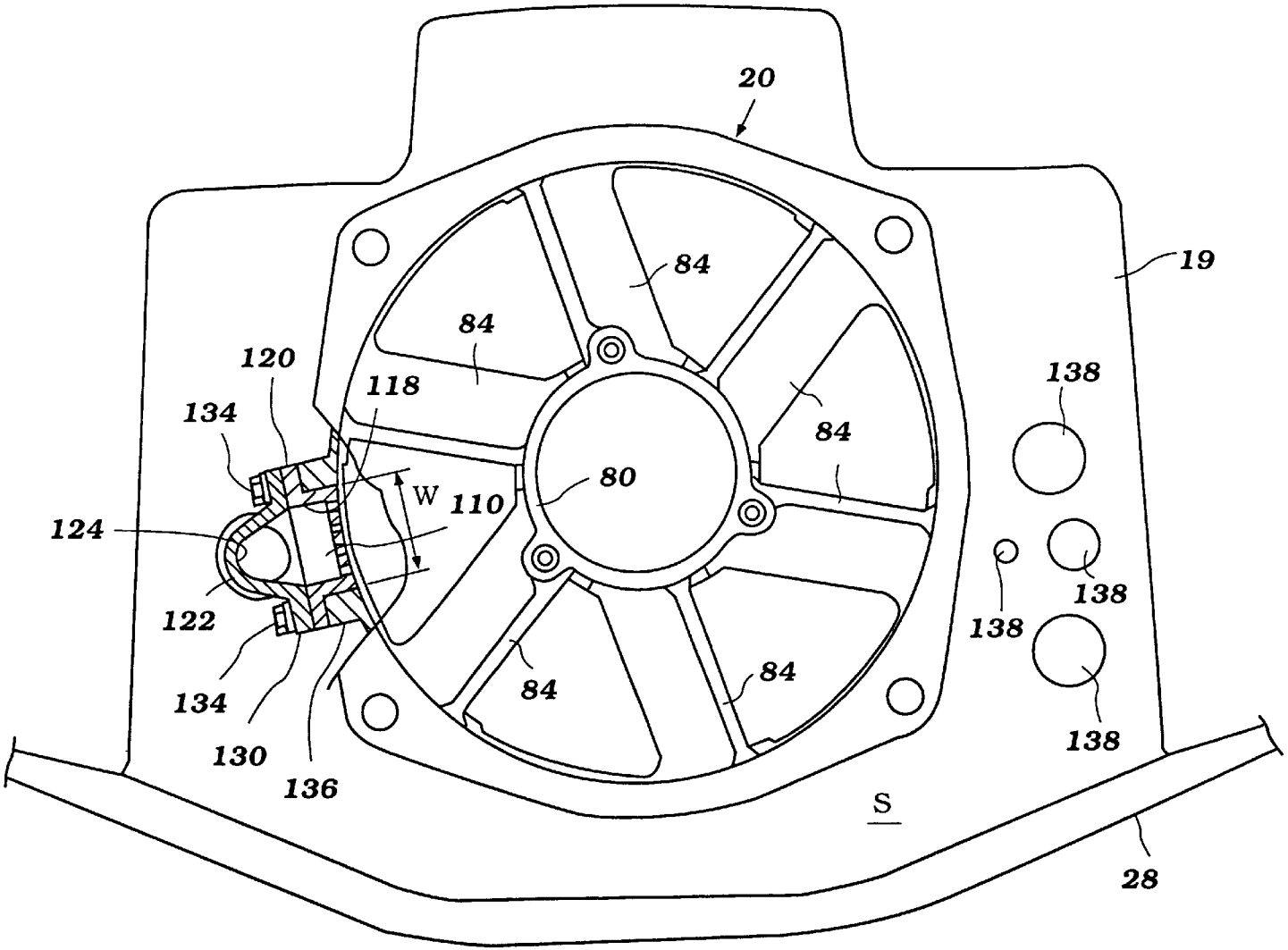
FIG. 3 is a cross-sectional view of the jet propulsion unit taken along line 3—3 of FIG. 2.
Figure 4:
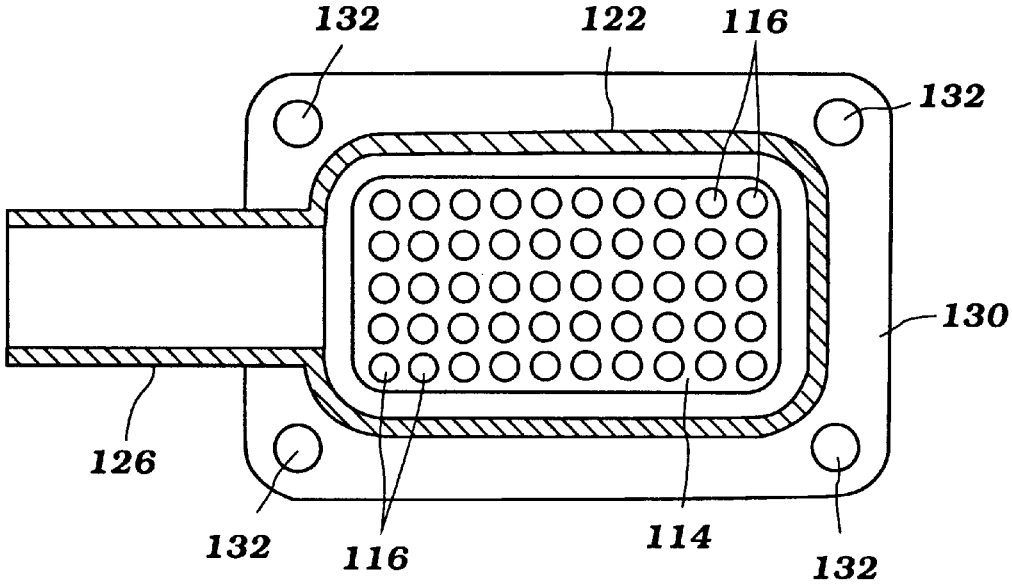
FIG. 4 is a partial cross-sectional view of the water inlet tap on the jet propulsion unit taken along line 4—4 of FIG. 2.

In the illustrated embodiment, as best seen in FIGS. 2 through 4, the tap 106 communicates with the pressurized chamber formed within the impeller duct assembly 76 through an effluent port 110. The effluent port 110 is formed through a wall of the housing 82 at a position between two of the straightening vanes 84. As understood from FIG. 3, the effluent port 110 desirably lies on a side of the jet propulsion unit 20 opposite the side on which the steering and trim actuators are position. The importance of this arrangement will be described below.

The length of the effluent port 110 desirably is greater than its width. That is, the dimension L of the port 110, as measured in the direction of water flow (i.e., in the direction of the rotational axis of the impeller shaft 30), is greater that the dimension W of the effluent port 110, as measured across the opening 110 between the vanes 84 and perpendicular to the direction of water flow (i.e., in a cross section direction). The dimension W is thus generally equal to a circumferential dimension of the opening 110. In an exemplary embodiment, the effluent port 110 has a length L equal to about 50 mm and a width W equal to about 25 mm. As a result, the area of the opening 110 is maximized while fitting between the vanes 84.

The water inlet tap 106 includes a filter 112 which is installed in the effluent port 110. The filter 112 includes a filtering element 114 that is coextensive with the effluent port 110. The filtering element 112 includes a plurality of openings 116 which permit water to pass through the filtering element 1124 but separates small rocks, sand or other small debris from the water. In the illustrated embodiment, as best understood from FIGS. 3 and 4, the filtering element 114 includes a plurality of small holes 116 (e.g., 3 mm in diameter) that are arranged in a rectangular grid-like pattern.

The filtering element 114 desirably is positioned at an inner side of the effluent port 110 so as to lie generally flush with the inner wall 86 of the housing 82. In the illustrated embodiment, the filtering element 114 has an arcuate shape. A radius of curvature of the filtering element 114 generally matches that of the inner cylindrical wall 86, such that the filtering element 114 blends smoothly into the side of the pressurized chamber. At this location, the principal flow of water through the jet propulsion unit 20 tends to sweep away debris at the inlet of the tap 106 in order inhibit fouling of the filter 112.

A skirt 118 surrounds the periphery of the filtering element 114 and slips fits within the effluent port 110 to hold the filtering element 114 at the desired position. The outer end of the skirt 118 is connected to a mounting flange 120. The mounting flange 120 extends about the exterior of the skirt 118 and sits against the exterior surface of the housing 82. With the mounting flange 120 juxtaposed with the housing exterior surface, the skirt 118 locates and supports the filtering element 114 at the desired position. In this manner, the skirt 118 acts like a strut, positioning and supporting the filtering element 114.

As seen in FIGS. 2 through 4, the water inlet tap 106 also includes a fitting 122 that mates with the filter 112. The fitting 122 includes a inlet opening that desirably is coextensive with an outlet opening of the filter 112 (as defined by the hollow skirt). A passage 124 extends from the inlet opening to a tube nipple 126. The passage 124 desirably turns 90 degrees within the fitting 122 such that the tube nipple 126 extends forward toward the bulkhead 19 and generally parallel to the jet propulsion unit 20. A connection pipe 128 links the tube nipple 126 on the fitting 122 with the delivery hose 108 of the water cooling system in order to facilitate quick disconnect between the hose 108 and the fitting 122 when servicing the filter 112, as described below.

The fitting 122 also includes a mounting flange 130. The mounting flange 130 has a similar shape and size to that of the filter mounting flange 120, and is designed to sit atop the filter mounting flange 120. Both mounting flanges 120, 130 include a plurality of through holes 132 (see FIG. 4). In the illustrated embodiment, the through holes 132 are positioned at the corners of the rectangular mounting flanges 120, 130, and corresponding through holes 132 of the two flanges 120, 130 are aligned.

As seen in FIG. 3, a plurality of bolts 134 secure the fitting 122 and the filter 112 of the water tap 106 to the side of the impeller assembly housing 82. The bolts 134 thread into correspondingly threaded holes formed in a boss 136 on the housing 82. The boss 134 circumscribes the effluent port 110. In this manner, the filter 112 and the fitting 122 are connected together and are removably attached to the housing 82.

The water inlet tap 106 desirably lies on a side of the jet pump unit 20 opposite of the steering nozzle actuator(s). In the illustrated embodiment, the bowden-wire cable(s) extend along one side of the jet pump unit 20 and pass through a hole(s) 138 formed in the bulkhead 19. The effluent port 110 is formed on an opposite side of the jet pump unit 20 relative to a vertical, longitudinally extending, central plane of the watercraft 10. This arrangement permits easy access to the water inlet trap 106 for servicing, without interference from the actuator cables.

The filter 112 though requires less frequent servicing than an inline-filter because of its location. The principal flow of pressurized water through the jet pump unit 20 tend to remove the filtered articles, such as sand, small pebbles and other debris, from the face of the filtering element 114. The filter 112 thus fouls less often and requires less servicing. When servicing does become necessary, the filter's accessible, unobstructed location within the pump chamber S eases this task.

Figure 5:
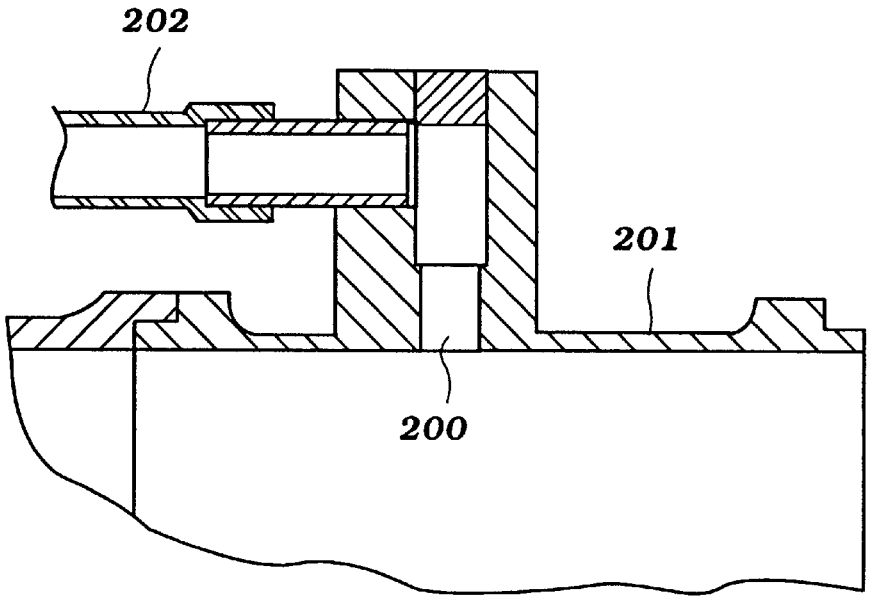
FIG. 5 is a partial cross-sectional view of a water inlet tap on a prior jet propulsion unit.

As noted above in the "Description of Related Art", those prior water taps 200 of the pump housing 201 which are open, such as the one illustrated in FIG. 5, are susceptible to clogging by small objects. In addition, such object can create clogs at other locations in the cooling system, such as the delivery line 202, after they pass through the water tap 200. With the inlet water tap 106 of the present cooling system, however, the filter 112 screens out small objects, which can clog either the delivery lines and/or the water jackets of the cooling system. The filter 112 therefore help ensure that ample cooling water is supplied to at least the engine water jacket and to the water jacket that surrounds the catalytic treatment system in order to maintain proper functioning the engine and the catalytic treatment system.

Although this invention has been described in terms of a certain preferred embodiment, other embodiments apparent to those of ordinary skill in the art are also within the scope of this invention. Accordingly, the scope of the invention is intended to be defined only by the claims that follow.

What is claimed is:

1. A small watercraft comprising an internal combustion engine driving a jet propulsion unit, said jet propulsion unit including a discharge nozzle, an impeller which acts upon water within the jet propulsion unit and forces the water through the discharge nozzle which is located downstream of the impeller, and an effluent port formed through a housing of the jet propulsion unit at a location downstream of the impeller, and a cooling system for the engine including a water inlet tap connected to said effluent port the inlet tap including a filter positioned within the effluent port and being substantially coextensive therewith, said filter including a plurality of openings, wherein the jet propulsion unit is located in a recessed cavity formed on the underside of the hull, additionally comprising a steering operator coupled to a steering nozzle of the jet propulsion unit via an actuator, said steering nozzle being arranged to receive water from the discharge nozzle, and said water effluent port being provided on a side of the jet propulsion unit opposite a side on which the actuator is located.

2. A small watercraft as in claim 1, wherein the cooling system includes at least one cooling jacket juxtaposed with at least a portion of the engine and a conduit that communicates between the water inlet tap and the cooling jacket.

3. A small watercraft as in claim 1, wherein the jet propulsion unit additionally includes a pressurization chamber interposed between said impeller and said discharge nozzle, and the effluent port is formed through a wall of the pressurization chamber.

4. A small watercraft as in claim 1, wherein the filter lies generally flush with an interior surface of the jet propulsion unit through which the effluent port passes.

5. A small watercraft as in claim 1, wherein said actuator includes at least one axially movable cable.

6. A small watercraft as in claim 1, wherein said water inlet tap includes a fitting that covers the filter, and said fitting and said filter are removably attached to a housing of the jet propulsion unit.

7. A small watercraft as in claim 6, wherein the filter and the fitting are connected together.

8. A small watercraft comprising an internal combustion engine driving a jet propulsion unit, said jet propulsion unit including a discharge nozzle, an impeller which acts upon water within the jet propulsion unit and forces the water through the discharge nozzle which is located downstream of the impeller, and an effluent port formed through a housing of the jet propulsion unit at a location downstream of the impeller, and a cooling system for the engine including a water inlet tap connected to said effluent port, the inlet tap including a filter positioned within the effluent port and being substantially coextensive therewith, said filter including a plurality of openings of stationary vanes arranged downstream of the impeller and spaced apart from one another, and said water effluent port is formed in a space between at least two of said vanes.

9. A small watercraft as in claim 8, wherein the cooling system includes at least one cooling jacket juxtaposed with at least a portion of the engine and a conduit that communicates between the water inlet tap and the cooling jacket.

10. A small watercraft as in claim 8, wherein the jet propulsion unit additionally includes a pressurization chamber interposed between said impeller and said discharge nozzle, and the effluent port is formed through a wall of the pressurization chamber.

11. A small watercraft as in claim 8, wherein the filter lies generally flush with an interior surface of the jet propulsion unit through which the effluent port passes.

12. A small watercraft as in claim 8, wherein said water inlet tap includes a fitting that covers the filter, and said fitting and said filter are removably attached to a housing of the jet propulsion unit.

13. A small watercraft as in claim 12, wherein the filter and the fitting are connected together.

14. A small watercraft comprising an internal combustion engine driving a jet propulsion unit, said jet propulsion unit including a discharge nozzle, an impeller which acts upon water within the jet propulsion unit and forces the water through the discharge nozzle which is located downstream of the impeller, and an effluent port formed through a housing of the jet propulsion unit at a location downstream of the impeller, and a cooling system for the engine including a water inlet tap connected to said effluent port, the inlet tap including a filter positioned within the effluent port and being substantially coextensive therewith, said filter including a plurality of openings, wherein a length of the effluent port, as measured in a direction parallel to a longitudinal axis of the watercraft, is greater than a width of the port, as measured in cross section in a direction generally perpendicular to the longitudinal axis.

15. A small watercraft as in claim 14, wherein the cooling system includes at least one cooling jacket juxtaposed with at least a portion of the engine and a conduit that communicates between the water inlet tap and the cooling jacket.

16. A small watercraft as in claim 14, wherein the jet propulsion unit additionally includes a pressurization chamber interposed between said impeller and said discharge nozzle, and the effluent port is formed through a wall of the pressurization chamber.

17. A small watercraft as in claim 14, wherein the filter lies generally flush with an interior surface of the jet propulsion unit through which the effluent port passes.

18. A small watercraft as in claim 14, wherein said water inlet tap includes a fitting that covers the filter, and said fitting and said filter are removably attached to a housing of the jet propulsion unit.

19. A small watercraft as in claim 18, wherein the filter and the fitting are connected together.

20. A jet propulsion unit comprising an impeller, a discharge nozzle, and a pressurization chamber positioned between the impeller and the discharge nozzle, the jet propulsion unit further comprising a water effluent port that communicates with the pressurization chamber and a filter removably installed within the effluent port, said filter being arranged to lie generally flush with an inner surface of the pressurization chamber, additionally comprising a tap connected to said pressurization chamber and communicating with said effluent port, wherein said filter includes a filtering element containing a plurality of openings, and a support structure comprising at least one mounting flange positioned on an outer side of the effluent port, and at least one strut arranged between the mounting flange and the filtering element to support the filtering element within the effluent port proximate to the pressurization chamber.

21. A jet propulsion unit as in claim 20, wherein the tap includes a fitting that is removably attached to a housing of the pressurization chamber with the filter mounting flange interposed between the fitting and the housing to releasably secure the filter in place.

22. A jet propulsion unit as in claim 21, wherein the fitting and the filter are connected together.

23. A jet propulsion unit as in claim 21, wherein the fitting includes a hose nipple.

24. A small watercraft comprising a hull including a recessed tunnel disposed on an underside of the hull, a jet propulsion unit disposed at least partially within the tunnel, an internal combustion engine positioned within the hull and drivingly coupled to the jet propulsion unit, and a cooling system for the engine, the cooling system communicating with the jet pump unit through an effluent port on the jet propulsion unit, the effluent port on the jet propulsion unit being positioned within the tunnel, and a filter arranged across the effluent port, the filter being at least substantially coextensive with the effluent port and including a plurality of openings wherein said jet propulsion unit comprises an impeller and a plurality of stationary vanes arranged downstream of the impeller and spaced apart from one another, and said effluent port is formed in a space between at least two of said vanes.

25. A small watercraft as in claim 24, wherein the cooling system includes a water tap connected to the jet propulsion unit and communicating with the effluent port, the water tap being positioned within the tunnel.

26. A small watercraft as in claim 25, wherein the cooling system additionally includes a delivery line connected to the water tap, and the delivery line extends through a wall of the tunnel.

27. A small watercraft comprising a hull including a recessed tunnel disposed on an underside of the hull, a jet propulsion unit disposed at least partially within the tunnel, an internal combustion engine positioned within the hull and drivingly coupled to the jet propulsion unit, and a cooling system for the engine, the cooling system communicating with the jet pump unit through an effluent port on the jet propulsion unit, the effluent port on the jet propulsion unit being positioned within the tunnel, and a filter arranged across the effluent port, the filter being at least substantially coextensive with the effluent port and including a plurality of openings, the jet propulsion unit further comprising a steering nozzle, the steering nozzle being arranged to receive water from another portion of the jet propulsion unit, a steering operator being connected to the steering nozzle with an actuator, and the effluent port and the actuator being disposed on opposite sides of the jet propulsion unit from one another.

28. A small watercraft as in claim 27, wherein the cooling system includes a water tap connected to the jet propulsion unit and communicating with the effluent port, the water tap being positioned within the tunnel.

29. A small watercraft as in claim 28, wherein the cooling system additionally includes a delivery line connected to the water tap, and the delivery line extends through a wall of the tunnel.

30. A small watercraft as in claim 27, wherein the actuator includes at least one axially, moveable cable.

31. A small watercraft comprising a hull including a recessed tunnel disposed on an underside of the hull, a jet propulsion unit disposed at least partially within the tunnel, an internal combustion engine positioned within the hull and drivingly coupled to the jet propulsion unit, and a cooling system for the engine, the cooling system communicating with the jet pump unit through an effluent port on the jet propulsion unit, the effluent port on the jet propulsion unit being positioned within the tunnel, and a filter arranged across the effluent port, the filter being at least substantially coextensive with the effluent port and including a plurality of openings, wherein a length of the effluent port, as measured in a direction parallel to a longitudinal axis of the watercraft is greater than a width of the port, as measured in cross section in a direction generally perpendicular to the longitudinal axis.

32. A small watercraft as in claim 31, wherein the cooling system includes a water tap connected to the jet propulsion unit and communicating with the effluent port, the water tap being positioned within the tunnel.

33. A small watercraft as in claim 32, wherein the cooling system additionally includes a delivery line connected to the water tap, and the delivery line extends through a wall of the tunnel.

34. A small watercraft comprising a hull including a recessed tunnel disposed on an underside of the hull, a jet propulsion unit disposed at least partially within the tunnel, an internal combustion engine positioned within the hull and drivingly coupled to the jet propulsion unit, and a cooling system for the engine, the cooling system communicating with the jet pump unit through an effluent port on the jet propulsion unit, the effluent port on the jet propulsion unit being positioned within the tunnel, and a filter arranged across the effluent port, the filter being at least substantially coextensive with the effluent port and including a plurality of openings, wherein said filter includes a filtering element and a support structure comprising at least one mounting flange positioned on an outer side of the effluent port, the support structure also comprising at least one strut arranged between the mounting flange and the filtering element to support the filtering element within the effluent port.

35. A small watercraft as in claim 34, wherein the cooling system includes a water tap connected to the jet propulsion unit and communicating with the effluent port, the water tap being positioned within the tunnel.

36. A small watercraft as in claim 35, wherein the cooling system additionally includes a delivery line connected to the water tap, and the delivery line extends through a wall of the tunnel.

* * * * *